US009734764B2

(12) United States Patent
Park et al.

(10) Patent No.: US 9,734,764 B2
(45) Date of Patent: Aug. 15, 2017

(54) VOLTAGE DROP COMPENSATOR FOR DISPLAY PANEL AND DISPLAY DEVICE INCLUDING THE SAME

(71) Applicant: Samsung Display Co., Ltd., Yongin-si, Gyeonggi-do (KR)

(72) Inventors: Gilbae Park, Hwaseong-si (KR); Heesook Park, Siheung-si (KR); Joonsuk Baik, Suwon-si (KR); Jihye Eom, Hwaseong-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 0 days.

(21) Appl. No.: 14/857,609

(22) Filed: Sep. 17, 2015

(65) Prior Publication Data

US 2016/0240140 A1 Aug. 18, 2016

(30) Foreign Application Priority Data

Feb. 13, 2015 (KR) ..... 10-2015-0022066

(51) Int. Cl.
*G09G 5/00* (2006.01)
*G09G 3/3258* (2016.01)
(Continued)

(52) U.S. Cl.
CPC ..... *G09G 3/3258* (2013.01); *G09G 3/3208* (2013.01); *G09G 3/3666* (2013.01);
(Continued)

(58) Field of Classification Search
CPC ..... G09G 3/3258; G09G 2300/043; G09G 3/3241; G09G 3/3233; G09G 2320/0626; G09G 2330/021
(Continued)

(56) References Cited

U.S. PATENT DOCUMENTS

2010/0149162 A1* 6/2010 Park ..... G09G 3/2007 345/212
2014/0062989 A1* 3/2014 Ebisuno ..... G09G 3/3241 345/212
(Continued)

FOREIGN PATENT DOCUMENTS

KR 10-2004-0059037 A 7/2004
KR 10-2005-0042193 A 5/2005
(Continued)

OTHER PUBLICATIONS

Extended European Search Report dated Jun. 30, 2016 for European Patent Application No. EP 16 155 456.3 which corresponds to subject U.S. Appl. No. 14/857,609.

*Primary Examiner* — Jennifer Nguyen
(74) *Attorney, Agent, or Firm* — Knobbe Martens Olson & Bear LLP

(57) ABSTRACT

A voltage drop compensator for a display device and the display device including the same are disclosed. In one aspect, the voltage drop compensator includes a region divider, an expected current calculator, a conversion matrix generator, a representative voltage calculator, and a compensator. The region divider is configured to divide the display panel into a plurality of regions, and the display panel includes a plurality of power lines and a plurality of pixels configured to receive a power voltage via the power lines. The expected current calculator is configured to calculate an expected current to flow in each of the regions based on input data provided to each of the regions. The conversion matrix generator configured to generate a conversion matrix based on a line resistance of each of the power lines and convert the expected current to a representative voltage provided to the regions based on the conversion matrix.

19 Claims, 12 Drawing Sheets

(51) Int. Cl.
*G09G 3/3208* (2016.01)
*G09G 3/36* (2006.01)

(52) U.S. Cl.
CPC ..... *G09G 2300/043* (2013.01); *G09G 2320/0223* (2013.01); *G09G 2360/16* (2013.01)

(58) Field of Classification Search
USPC ..... 345/211, 690, 76, 212
See application file for complete search history.

(56) References Cited

U.S. PATENT DOCUMENTS

| | | | | |
|---|---|---|---|---|
| 2014/0125131 | A1* | 5/2014 | Lalitnuntikul ..... | G06F 1/266 307/31 |
| 2016/0125807 | A1* | 5/2016 | Wang ..... | G09G 3/3258 345/205 |

FOREIGN PATENT DOCUMENTS

| | | | |
|---|---|---|---|
| KR | 10-2009-0077061 | A | 7/2009 |
| KR | 10-2010-0014106 | A | 2/2010 |
| KR | 10-2010-0068075 | A | 6/2010 |
| KR | 10-2011-0062764 | A | 6/2011 |

* cited by examiner

| SUM OF GRAYSCALE VALUE (Gx) | EXPECTED CURRENT (Zx) |
|---|---|
| G0 | Z0 |
| G1 | Z1 |
| G2 | Z2 |
| ⋮ | ⋮ |
| Gmax | Zmax |

FIG. 4C $$\overset{Z}{\begin{bmatrix} Z(1,1) \\ Z(1,2) \\ Z(2,1) \\ Z(2,2) \end{bmatrix}} = \overset{A}{\begin{bmatrix} -2\left(\frac{1}{R1}+\frac{1}{R2}\right) & \frac{1}{R1} & \frac{1}{R2} & 0 \\ \frac{1}{R1} & -2\left(\frac{1}{R1}+\frac{1}{R2}\right) & 0 & \frac{1}{R2} \\ \frac{1}{R2} & 0 & -2\left(\frac{1}{R1}+\frac{1}{R2}\right) & \frac{1}{R1} \\ 0 & \frac{1}{R2} & \frac{1}{R1} & -2\left(\frac{1}{R1}+\frac{1}{R2}\right) \end{bmatrix}} \times \overset{V}{\begin{bmatrix} V(1,1) \\ V(1,2) \\ V(2,1) \\ V(2,2) \end{bmatrix}}$$

FIG. 4D $$\overset{V}{\begin{bmatrix} V(1,1) \\ V(1,2) \\ V(2,1) \\ V(2,2) \end{bmatrix}} = \overset{B}{\begin{bmatrix} -2\left(\frac{1}{R1}+\frac{1}{R2}\right) & \frac{1}{R1} & \frac{1}{R2} & 0 \\ \frac{1}{R1} & -2\left(\frac{1}{R1}+\frac{1}{R2}\right) & 0 & \frac{1}{R2} \\ \frac{1}{R2} & 0 & -2\left(\frac{1}{R1}+\frac{1}{R2}\right) & \frac{1}{R1} \\ 0 & \frac{1}{R2} & \frac{1}{R1} & -2\left(\frac{1}{R1}+\frac{1}{R2}\right) \end{bmatrix}^{-1}} \times \overset{Z}{\begin{bmatrix} Z(1,1) \\ Z(1,2) \\ Z(2,1) \\ Z(2,2) \end{bmatrix}}$$

FIG. 5C $$\begin{bmatrix} Z(1,1) \\ Z(1,2) \\ Z(2,1) \\ Z(2,2) \end{bmatrix} = \overbrace{\begin{bmatrix} \frac{2}{R1} & \frac{1}{R1} & 0 & 0 \\ \frac{1}{R1} & \frac{2}{R1} & 0 & 0 \\ 0 & 0 & \frac{2}{R1} & \frac{1}{R1} \\ 0 & 0 & \frac{1}{R1} & \frac{2}{R1} \end{bmatrix}}^{C} \times \begin{bmatrix} V(1,1) \\ V(1,2) \\ V(2,1) \\ V(2,2) \end{bmatrix}$$

FIG. 5D $$\begin{bmatrix} V(1,1) \\ V(1,2) \\ V(2,1) \\ V(2,2) \end{bmatrix} = \overbrace{\begin{bmatrix} \frac{2}{R1} & \frac{1}{R1} & 0 & 0 \\ \frac{1}{R1} & \frac{2}{R1} & 0 & 0 \\ 0 & 0 & \frac{2}{R1} & \frac{1}{R1} \\ 0 & 0 & \frac{1}{R1} & \frac{2}{R1} \end{bmatrix}}^{D}{}^{-1} \times \begin{bmatrix} Z(1,1) \\ Z(1,2) \\ Z(2,1) \\ Z(2,2) \end{bmatrix}$$

FIG. 6C $$\begin{bmatrix} Z(1,1) \\ Z(1,2) \\ Z(2,1) \\ Z(2,2) \end{bmatrix} = \overbrace{\begin{bmatrix} -\frac{2}{R2} & 0 & \frac{1}{R2} & 0 \\ 0 & -\frac{2}{R2} & 0 & \frac{1}{R2} \\ \frac{1}{R2} & 0 & -\frac{2}{R2} & 0 \\ 0 & \frac{1}{R2} & 0 & -\frac{2}{R2} \end{bmatrix}}^{E} \times \begin{bmatrix} V(1,1) \\ V(1,2) \\ V(2,1) \\ V(2,2) \end{bmatrix}$$

FIG. 6D $$\begin{bmatrix} V(1,1) \\ V(1,2) \\ V(2,1) \\ V(2,2) \end{bmatrix} = \overbrace{\begin{bmatrix} -\frac{2}{R2} & 0 & \frac{1}{R1} & 0 \\ 0 & -\frac{2}{R2} & 0 & \frac{1}{R1} \\ \frac{1}{R1} & 0 & -\frac{2}{R2} & 0 \\ 0 & \frac{1}{R1} & 0 & -\frac{2}{R2} \end{bmatrix}}^{F^{-1}} \times \begin{bmatrix} Z(1,1) \\ Z(1,2) \\ Z(2,1) \\ Z(2,2) \end{bmatrix}$$

VOLTAGE DROP COMPENSATOR FOR DISPLAY PANEL AND DISPLAY DEVICE INCLUDING THE SAME

INCORPORATION BY REFERENCE TO ANY PRIORITY APPLICATIONS

This application claims priority under 35 USC §119 to Korean Patent Application No. 10-2015-0022066, filed on Feb. 13, 2015 in the Korean Intellectual Property Office (KIPO), the contents of which are incorporated herein in its entirety by reference.

BACKGROUND

Field

The described technology generally relates to a voltage drop compensator for a display panel and a display device including the same.

Description of the Related Technology

Flat panel displays (FPDs) are widely used because they are relatively lightweight and thin compared to cathode-ray tube (CRT) displays. Examples include liquid crystal displays (LCDs), field emission displays (FEDs), plasma display panels (PDPs), and organic light-emitting diode (OLED) displays. OLED technology has been considered a next-generation display due to its favorable characteristics such as wide viewing angles, rapid response speeds, thin profiles, low power consumption, etc.

SUMMARY OF CERTAIN INVENTIVE ASPECTS

One inventive aspect relates to a voltage drop compensator for a display panel that can compensate a voltage drop occurs on the display panel and a display device including the same.

Another aspect is a voltage drop compensator for a display panel that includes a region divider configured to divide a display panel that includes a plurality of power lines and a plurality of pixels that receive a power voltage through the power lines into a plurality of regions, an expected current calculator configured to calculate an expected current spent in each of the plurality of regions based on input data provided to each of the plurality of regions, a conversion matrix generator configured to generate a conversion matrix that converts the expected current to a representative voltage provided to the plurality of regions based on a line resistance of the power line, a representative voltage calculator configured to calculate the representative voltage by multiplying the conversion matrix and the expected current, and a compensator configured to calculate an amount of a voltage drop in each of the regions based on the representative voltage, and output a compensated data that compensates the amount of the voltage drop in each of the regions.

In example embodiments, the conversion matrix generator generates the conversion matrix based on a power current flowing through the power line and the line resistance of the power line.

In example embodiments, the power lines are formed on the display panel in a first direction and a second direction that is perpendicular to the first direction.

In example embodiments, the conversion matrix generator generates a resistance matrix based on the equation, "$Z(m,n)=\{V(m,n-1)-2V(m,n)+V(m,n+1)\}/R1+\{V(m-1,n)-2V(m,n)+V(m+1,n)\}/R2$", where the m, n are natural numbers greater than or equal to 1, Z is the expected current, V is the representative voltage, R1 is the line resistance of the power lines formed in the first direction, and R2 is the line resistance of the power lines formed in the second direction, and generates an inverse of the resistance matrix as the conversion matrix.

In example embodiments, the power lines are formed in a first direction.

In example embodiments, the conversion matrix generator generates a resistance matrix based on the equation, "$Z(m,n)=\{V(m,n-1)-2V(m,n)+V(m,n+1)\}/R1$", where the m, n are natural numbers greater than or equal to 1, Z is the expected current, V is the representative voltage, and R1 is the line resistance of the power lines formed in the first direction, and generates an inverse of the resistance matrix as the conversion matrix.

In example embodiments, the power lines are formed in a second direction.

In example embodiments, the conversion matrix generator generates a resistance matrix based on the equation, "$Z(m,n)=\{V(m-1,n)-2V(m,n)+V(m+1,n)\}/R2$", where the m, n are natural numbers greater than or equal to 1, Z is the expected current, V is the representative voltage, and R2 is the line resistance of the power lines formed in the second direction, and generates an inverse of the resistance matrix as the conversion matrix.

In example embodiments, the conversion matrix generator includes a look up table (LUT) that stores the conversion matrix.

In example embodiments, the expected current calculator calculates the expected current corresponding to grayscale values of the input data provided to each of the regions based on a predetermined ratio.

In example embodiments, the expected current calculator includes a look up table that stores the expected current corresponding to grayscale values of the input data provided to each of the plurality of regions.

In example embodiments, the voltage drop compensator further includes an interpolator configured to interpolate the representative voltages of the plurality of regions.

Another aspect is a display device that includes a display panel including the plurality of power lines and a plurality of pixels that receives a power voltage through the power lines, a voltage drop compensator configured to divide the display panel into a plurality of regions, calculate a representative voltage of the plurality of regions by multiplying a conversion matrix calculated based on a line resistance of the power line and an expected current spent in the plurality of regions, and compensate an amount of a voltage drop of the plurality of regions based on the representative voltage, a data driver configured to provide a data signal to the plurality of pixels, a scan driver configured to provide a scan signal to the plurality of pixels, and a timing controller configured to control the data driver, the scan driver, and the voltage drop compensator.

In example embodiments, the voltage drop compensator includes a region divider configured to divide the display panel into the plurality of regions, an expected current calculator configured to calculate the expected current spent in each of the plurality of regions based on input data provided to each of the plurality of regions, a conversion matrix generator configured to generate the conversion matrix that converts the expected current to the representative voltage provided to the plurality of regions based on the resistance of the power line, a representative voltage calculator configured to calculate the representative voltage by multiplying the conversion matrix and the expected current, and a compensator configured to calculate the amount of the voltage drop in each of the regions based on the representative voltage and to output compensated data that compensates the amount of the voltage drop in each of the regions.

In example embodiments, the conversion matrix generator generates the conversion matrix based on the power current flowing through the power line and the line resistance of the power line.

In example embodiments, the conversion matrix generator generates a resistance matrix based on the equation, "$Z(m,n)=\{V(m,n-1)-2V(m,n)+V(m,n+1)\}/R1+\{V(m-1,n)-2V(m,n)+V(m+1,n)\}/R2$", where the m, n are natural numbers greater than or equal to 1, Z is the expected current, V is the representative voltage, R1 is the line resistance of the power lines formed in a first direction, and R2 is the line resistance of the power lines formed in a second direction, and generates an inverse of the resistance matrix as the conversion matrix when the power lines are formed in the first direction and the second direction that is perpendicular to the first direction on the display panel.

In example embodiments, the conversion matrix generator generates a resistance matrix based on the equation, "$Z(m,n)=\{V(m,n-1)-2V(m,n)+V(m,n+1)\}/R1$", where the m, n are natural numbers greater than or equal to 1, Z is the expected current, V is the representative voltage, and R1 is the line resistance of the power lines formed in a first direction, and generates an inverse of the resistance matrix as the conversion matrix when the power lines are formed in the first direction on the display panel.

In example embodiments, the memory is implemented as a frame memory that stores the grayscale data provided to the pixels per a frame.

In example embodiments, the conversion matrix generator generates a resistance matrix based on the equation, "$Z(m,n)=\{V(m-1,n)-2V(m,n)+V(m+1,n)\}/R2$", where the m, n are natural numbers greater than or equal to 1, Z is the expected current, V is the representative voltage, and R2 is the line resistance of the power lines formed in the second direction, and generates an inverse of the resistance matrix as the conversion matrix when the power lines are formed in the second direction on the display panel.

In example embodiments, the expected current calculator calculates the expected current corresponding to grayscale values of the input data provided to each of the plurality of regions based on a predetermined ratio.

In example embodiments, the display device further includes an interpolator configured to interpolate the representative voltages of the plurality of regions.

Another aspect is a voltage drop compensator for a display panel. The voltage drop compensator comprises a region divider configured to divide the display panel into a plurality of regions, wherein the display panel includes a plurality of power lines and a plurality of pixels configured to receive a power voltage via the power lines. The voltage drop compensator also comprises an expected current calculator configured to calculate an expected current to flow in each of the regions based on input data provided to each of the regions. The voltage drop compensator further comprises a conversion matrix generator configured to generate a conversion matrix based on a line resistance of each of the power lines and convert the expected current to a representative voltage provided to the regions based on the conversion matrix. The voltage drop compensator also comprises i) a representative voltage calculator configured to multiply the conversion matrix and the expected current so as to calculate the representative voltage and ii) a compensator configured to calculate an amount of a voltage drop in each of the regions based on the representative voltage and output a compensated data so as to compensate for the amount of the voltage drop in each of the regions.

In the above voltage drop compensator, the conversion matrix generator is further configured to generate the conversion matrix based on a power current flowing through each of the power lines.

In the above voltage drop compensator, the power lines are formed over the display panel in a first direction and a second direction crossing the first direction.

In the above voltage drop compensator, the conversion matrix generator can be further configured to generate a resistance matrix based on the equation, "$Z(m,n)=\{V(m,n-1)-2V(m,n)+V(m,n+1)\}/R1+\{V(m-1,n)-2V(m,n)+V(m+1,n)\}/R2$", where the m, n are natural numbers equal to or greater than 1, Z is the expected current, V is the representative voltage, R1 is the line resistance of the power lines formed in the first direction, and R2 is the line resistance of the power lines formed in the second direction, wherein the conversion matrix generator is further configured to generate an inverse of the resistance matrix as the conversion matrix.

In another aspect of the above voltage drop compensator, the power lines are formed in a first direction.

In the above voltage drop compensator, the conversion matrix generator can be further configured to generate a resistance matrix based on the equation, "$Z(m,n)=\{V(m,n-1)-2V(m,n)+V(m,n+1)\}/R1$", where the m, n are natural numbers equal to or greater than 1, Z is the expected current, V is the representative voltage, and R1 is the line resistance of the power lines formed in the first direction, and wherein the conversion matrix generator is further configured to generate an inverse of the resistance matrix as the conversion matrix.

In another aspect of the above voltage drop compensator, the power lines are formed in a second direction crossing the first direction.

In the above voltage drop compensator, the conversion matrix generator is further configured to generate a resistance matrix based on the equation, "$Z(m,n)=\{V(m-1,n)-2V(m,n)+V(m+1,n)\}/R2$", where the m, n are natural numbers equal to or greater than 1, Z is the expected current, V is the representative voltage, and R2 is the line resistance of the power lines formed in the second direction, and wherein the conversion matrix generator is further configured to generate an inverse of the resistance matrix as the conversion matrix.

In the above voltage drop compensator, the conversion matrix generator includes a look up table (LUT) configured to store the conversion matrix.

In the above voltage drop compensator, the expected current calculator is further configured to calculate the expected current corresponding to grayscale values of the input data based on a predetermined ratio.

In the above voltage drop compensator, the expected current calculator includes a look up table (LUT) configured to store the expected current corresponding to grayscale values of the input data.

The above voltage drop compensator further comprises an interpolator configured to interpolate the representative voltages of the regions.

Another aspect is a display device comprising: a display panel including a plurality of power lines and a plurality of pixels configured to receive a power voltage via the power lines; a voltage drop compensator configured to divide the display panel into a plurality of regions, calculate a conversion matrix based on a line resistance of each of the power lines, multiply the conversion matrix and an expected current to flow in the regions so as to calculate a representative voltage of the regions, and compensate for an amount of a voltage drop of the regions based on the representative voltage; a data driver configured to provide a data signal to the pixels; a scan driver configured to provide a scan signal to the pixels; and a timing controller configured to control the data driver, the scan driver, and the voltage drop compensator.

In the above display device, the voltage drop compensator includes: a region divider configured to divide the display panel into the regions; an expected current calculator configured to calculate the expected current to flow in each of the regions based on input data provided to each of the regions; a conversion matrix generator configured to generate the conversion matrix and convert the expected current to the representative voltage provided to the regions based on the line resistance of each of the power lines; a representative voltage calculator configured to multiply the conversion matrix and the expected current so as to calculate the representative voltage; and a compensator configured to calculate the amount of the voltage drop in each of the regions based on the representative voltage and output compensated data so as to compensate for the amount of the voltage drop in each of the regions.

In the above display device, the conversion matrix generator is further configured to generate the conversion matrix based on the power current flowing through each of the power lines.

In the above display device, the conversion matrix generator is further configured to generate a resistance matrix based on the equation, "$Z(m,n)=\{V(m,n-1)-2V(m,n)+V(m,n+1)\}/R1+\{V(m-1,n)-2V(m,n)+V(m+1,n)\}/R2$", where the m, n are natural numbers equal to or greater than 1, Z is the expected current, V is the representative voltage, R1 is the line resistance of the power lines formed in a first direction, and R2 is the line resistance of the power lines formed in a second direction, wherein the conversion matrix generator is further configured to generate an inverse of the resistance matrix as the conversion matrix, and wherein the power lines are formed in the first direction and the second direction crossing the first direction on the display panel.

In the above display device, the conversion matrix generator is further configured to generate a resistance matrix based on the equation, "$Z(m,n)=\{V(m,n-1)-2V(m,n)+V(m,n+1)\}/R1$", where the m, n are natural numbers equal to or greater than 1, Z is the expected current, V is the representative voltage, and R1 is the line resistance of the power lines formed in a first direction, wherein the conversion matrix generator is further configured to generate an inverse of the resistance matrix as the conversion matrix, and wherein the power lines are formed in the first direction on the display panel.

In the above display device, the conversion matrix generator is further configured to generate a resistance matrix based on the equation, "$Z(m,n)=\{V(m-1,n)-2V(m,n)+V(m+1,n)\}/R2$", where the m, n are natural numbers equal to or greater than 1, Z is the expected current, V is the representative voltage, and R2 is the line resistance of the power lines formed in the second direction, wherein the conversion matrix generator is further configured to generate an inverse of the resistance matrix as the conversion matrix, and wherein the power lines are formed in the second direction on the display panel.

In the above display device, the expected current calculator is further configured to calculate the expected current corresponding to grayscale values of the input data based on a predetermined ratio.

The above display device further comprises an interpolator configured to interpolate the representative voltages of the regions.

According to at least one of the disclosed embodiments, a voltage drop compensator for a display panel compensates a voltage drop of the display panel by dividing a display panel into a plurality of regions and calculating a voltage provided to each of the regions based on input data. Thus, the display device that includes the voltage drop compensator can improve a uniformity of brightness and a display quality.

BRIEF DESCRIPTION OF THE DRAWINGS

FIG. 4C is a diagram for describing an operation of a conversion matrix generator included in the voltage drop compensator for the display panel of FIG. 1.

FIG. 4D is a diagram for describing an operation of a representative voltage calculator included in the voltage drop compensator for the display panel of FIG. 1.

FIG. 5C is a diagram for describing an operation of a conversion matrix generator included in the voltage drop compensator for the display panel of FIG. 1.

FIG. 5D is a diagram for describing an operation of a representative voltage calculator included in the voltage drop compensator for the display panel of FIG. 1.

FIG. 6C is a diagram for describing an operation of a conversion matrix generator included in the voltage drop compensator for the display panel of FIG. 1.

FIG. 6D is a diagram for describing an operation of a representative voltage calculator included in the voltage drop compensator for the display panel of FIG. 1.

DETAILED DESCRIPTION OF CERTAIN INVENTIVE EMBODIMENTS

A voltage drop can occur while operating an OLED display due to the resistance of a voltage providing line. The voltage drop amount can change based on image data. Thus, the uniformity of brightness and an image quality can decrease.

Hereinafter, the described technology will be explained in detail with reference to the accompanying drawings. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1:
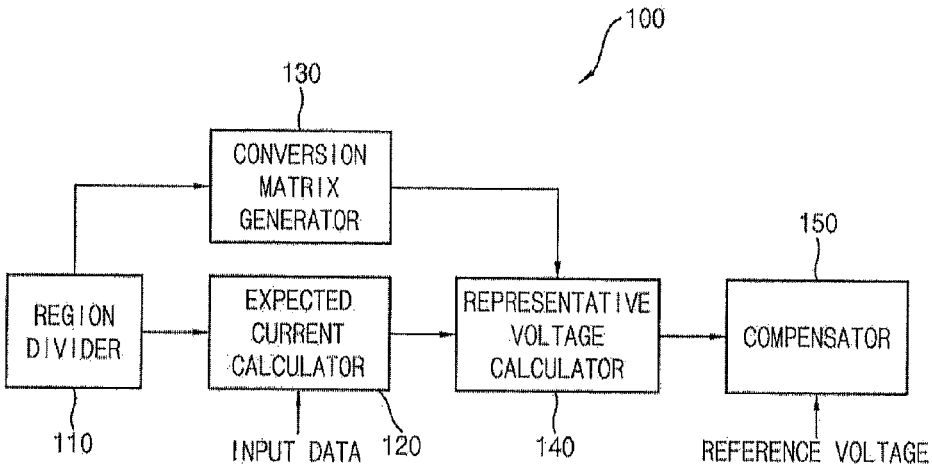
FIG. 1 is a block diagram illustrating a voltage drop a display panel according to example embodiments.

Referring to FIG. 1, a voltage drop compensator 100 of a display panel includes a region divider 110, an expected current calculator 120, a conversion matrix generator 130, a representative voltage calculator 140, and a compensator 150. Depending on embodiments, certain elements may be removed from or additional elements may be added to the voltage drop compensator 100 illustrated in FIG. 1. Furthermore, two or more elements may be combined into a single element, or a single element may be realized as multiple elements. This applies to the remaining apparatus embodiments.

Figure 2:
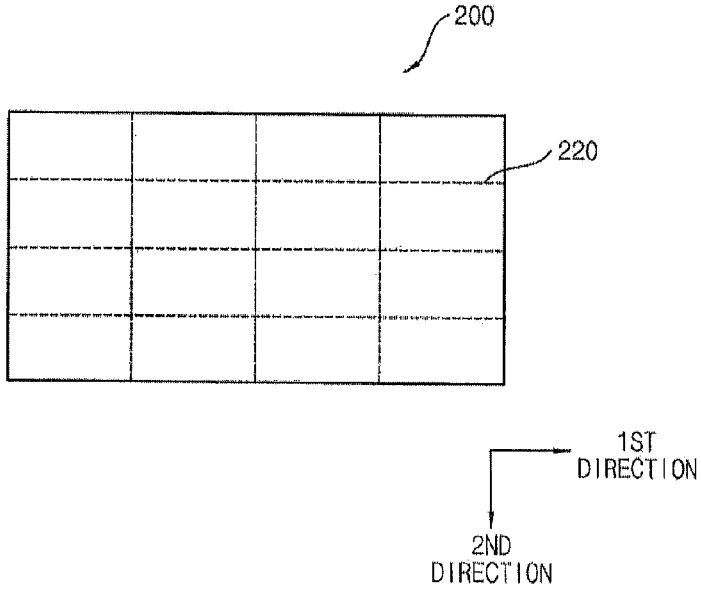
FIG. 2 is a diagram illustrating an example of the display panel divided into a plurality of regions by a region divider included in the voltage drop compensator for the display panel of FIG. 1.

The region divider 110 can divide a display panel 200 that includes a plurality of power lines and a plurality of pixels that receive a power voltage through the power lines into a plurality of regions. The region divider 110 can divide the display panel 200 into the regions using virtual lines 220. For example, the region divider 110 divides the display panel 200 into 16 virtual regions with 4 columns and 4 rows as described in FIG. 2. Although the display panel 200 divided into 16 virtual regions is described in FIG. 2, the number of the regions divided by the region divider 110 is not limited thereto.

The expected current calculator 120 can calculate the expected current to flow in each of the regions based on input data provided to the regions. The expected current can represent an amount of a current flown for outputting brightness corresponding to the input data provided to the pixels in the regions. In some example embodiments, the expected current calculator 120 calculates the expected current corresponding to grayscale values of the input data provided to each of the regions based on a predetermined ratio. The amount of the current flown for outputting brightness corresponding to the grayscale value, that is, the expected current can increase at a predetermined ratio as the grayscale value provided to the pixel increases. For example, the expected current calculator 120 calculates the sum of the grayscale values of the input data provided to the pixels in each of the regions, and outputs the amount of current flown in each of the regions as the expected current based on the predetermined ratio. In some example embodiments, the expected current calculator 120 includes a look up table (LUT) that stores the expected current corresponding to the grayscale value of the input data provided to each of the regions and output the expected current based on the look up table. The look up table can store the expected current to output the brightness corresponding to the grayscale value of the input data provided to each of the regions. For example, the expected current calculator 120 includes the look up table that stores the expected current corresponding to the sum of the grayscale value provided to each of the regions. It should be understood that the look up table can be implemented by any storage device that can store the expected current corresponding to the grayscale value of the input data provided to each of the regions. An operation of the expected current calculator 120 will be described in detail referring to FIGS. 3A and 3B.

The conversion matrix generator 130 can generate a conversion matrix that converts the expected current to a representative voltage provided to the regions based on the line resistance on the power line. Generally, the display panel 200 can provide the power voltage provided from a power supply to the pixels through the power lines. As the distance between the power supply and the pixel increases, the line resistance of the power line increases. Thus, as the distance between the power supply and the pixel increases, a voltage drop of the power voltage can increase. The conversion matrix generator 130 can generate the conversion matrix based on the power current flowing through the power line and the line resistance of the power line. In some example embodiments, the conversion matrix generator 130 generates a resistance matrix by using Equation 1 that is derived using the power current flowing through the power lines and the line resistor of the power lines when the power lines are formed in a first direction and a second direction that is substantially perpendicular to the first direction. The conversion matrix generator 130 can generate an inverse of the resistance matrix as the conversion matrix.

$$Z(M, N) = \frac{V(M, N-1) - 2V(M, N) + V(M, N+1)}{R1} + \frac{V(M-1, N) - 2V(M, N) + V(M+1, N)}{R2} \quad \text{(EQ. 1)}$$

where M, N are natural numbers equal to or greater than 1 that represent columns and rows of the regions, Z is the expected current, V is the representative voltage, R1 is the line resistance of the power lines formed in the first direction, and R2 is the line resistance of the power lines formed in the second direction. The line resistances R1 and R2 of the power lines formed in the first direction and the second direction can have a predetermined value determined through a measurement or an experiment. In some example embodiments, the line resistance R1 of the power lines formed in the first direction has the same value with the line resistance R2 of the power lines formed in the second direction. In some example embodiments, the line resistance R1 of the power lines formed in the first direction has the different value from the line resistance R2 of the power lines formed in the second direction. The expected current Z(M, N) flown in the region formed in a Mth column and a Nth row can be calculated by subtracting the power current output from the region formed in the Mth column and the Nth row in the first and second directions from the power current provided to the region formed in the Mth column and the Nth row in the first and second directions. Equation 1 will be described in detail referring to FIGS. 4A and 4B. The conversion matrix generator 130 can generate the resistance matrix using the equation 1. That is, the expected current can be calculated by multiplying the resistance matrix and the representative voltage. The conversion matrix generator 130 can generate an inverse of the resistance matrix as the conversion matrix.

In some example embodiments, the conversion matrix generator 130 generates the resistance matrix by using the Equation 2 that is derived using the power current flowing through the power lines and the line resistor of the power lines when the power lines are formed in the first direction. The conversion matrix generator 130 can generate an inverse of the resistance matrix as the conversion matrix.

$$Z(M, N) = \frac{V(M, N-1) - 2V(M, N) + V(M, N+1)}{R1} \quad \text{(EQ. 2)}$$

where M, N are natural numbers equal to or greater than 1 that represent columns and rows of the regions, Z is the expected current, V is the representative voltage, and R1 is the line resistance of the power lines formed in the first direction. The line resistance R1 of the power lines formed in the first direction can have a predetermined value determined through the measurement or the experiment. The expected current Z(M,N) flown in the region in the Mth column and the Nth row can be calculated by subtracting the power current output from the region formed in the Mth column and the Nth row in the first direction from the power current provided to the region formed in the Mth column and the Nth row in the first direction. The Equation 2 will be described in detail referring to FIGS. 5A and 5B. The conversion matrix generator 130 can generate the resistance matrix using the Equation 2. That is, the expected current Z(M,N) can be calculated by multiplying the resistance matrix and the representative voltage. The conversion matrix generator 130 can generate an inverse of the resistance matrix as the conversion matrix.

In some example embodiments, the conversion matrix generator 130 generates the resistance matrix by using the Equation 3 that is derived using the power current flowing through the power lines and the line resistor of the power lines when the power lines are formed in the second direction. The conversion matrix generator 130 can generate an inverse of the resistance matrix as the conversion matrix.

$$Z(M, N) = \frac{V(M-1, N) - 2V(M, N) + V(M+1, n)}{R2} \quad \text{(EQ. 3)}$$

where M, N are natural numbers equal to or greater than 1 that represent columns and rows of the plurality of regions, Z is the expected current, V is the representative voltage, and R2 is the line resistance of the power lines formed in the second direction. The line resistance R2 of the power lines formed in the second direction can have a predetermined value determined through the measurement or the experiment. The expected current Z(M,N) flown in the region in the Mth column and the Nth row can be calculated by subtracting the power current output from the region formed in the Mth column and the Nth row in the second direction. The Equation 3 will be described in detail referring to FIGS. 6A and 6B. The conversion matrix generator 130 can generate the resistance matrix using the Equation 3. That is, the expected current Z(M,N) can be calculated by multiplying the resistance matrix and the representative voltage. The conversion matrix generator 130 can generate an inverse of the resistance matrix as the conversion matrix. The conversion matrix generator 130 can include the look up table that store the conversion matrix.

The representative voltage calculator 140 can calculate the representative voltage of the regions by multiplying the conversion matrix and the expected current. The representative voltage calculator 140 can receive the conversion matrix from the conversion matrix generator 130, and can receive the expected current flown in each of the regions from the expected current calculator 120. The representative voltage of each of the regions can be calculated by multiplying of the conversion matrix and the expected current.

The compensator 150 can calculate the amount of voltage drop of each of the regions based on the representative voltage and output the compensated data that compensates the amount of voltage drop of each of the regions. The compensator 150 can calculate the amount of the voltage drop by comparing the representative voltage to a predetermined reference voltage. The compensator 150 can output the compensated data that compensates the amount of the voltage drop. In some example embodiments, the compensator 150 compensates the amount of the voltage drop by controlling a voltage level of the power voltage provided through the power lines to each of the regions based on the amount of the voltage drop. In some example embodiments, the compensator 150 compensates the amount of the voltage drop by controlling an emission time of the pixels in each of the regions based on the amount of the voltage drop. In some example embodiments, the compensator 150 compensates the amount of the voltage drop by controlling the grayscale value of the input data based on the amount of the voltage drop.

Although the voltage drop 100 that includes the region divider 110, the expected current calculator 120, the conversion matrix calculator 130, a representative voltage calculator 140, and the compensator 150 is described, the voltage drop compensator 100 is not limited thereto. For example, the voltage drop compensator 100 further includes an interpolator that interpolates the representative voltage of the regions. The interpolator can calculate the voltage of the pixels of the display panel 200 by interpolating the representative voltages calculated in the representative voltage calculator 140. Thus, the amount of the voltage drop can be minutely compensated.

As described above, the voltage drop compensator 100 of FIG. 1 can divide the display panel 200 on which the power lines are formed into the regions, calculate the expected current flown in each of the regions based on the input data, and calculate the conversion matrix based on the line resistance of the power lines and the expected current. The voltage drop compensator 100 can calculate the representative voltage in each of the regions based on the conversion matrix and the expected current and compensate the amount of the voltage drop of each of the regions.

Figures 3A, 3B:
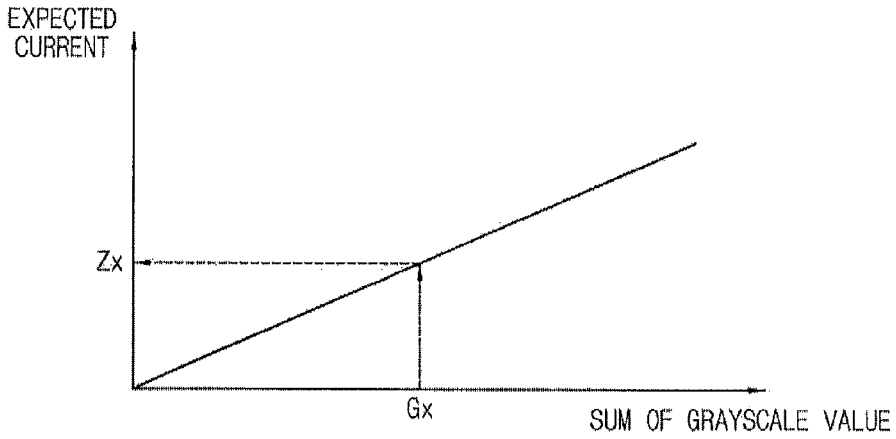
FIG. 3A is a diagram for describing an example of an operation of an expected current calculator included in the voltage drop compensator for the display panel of FIG. 1.
FIG. 3B is a diagram for describing another example of an operation of an expected current calculator included in the voltage drop compensator for the display panel of FIG. 1.

FIG. 3A is a diagram for describing an example of an operation of an expected current calculator included in the voltage drop compensator of the display panel of FIG. 1. FIG. 3B is a diagram for describing another example of an operation of an expected current calculator included in the voltage drop compensator of the display panel of FIG. 1.

Referring to FIG. 3A, an expected current calculator calculates an expected current corresponding to grayscale values of input data provided to each of a plurality of regions based on a predetermined ratio. The amount of the current flown for outputting brightness corresponding to the grayscale value, that is, the expected current can increase at a predetermined ratio as the grayscale value provided to the pixel increases. For example, the expected current calculator calculates the sum of the grayscale values of the input data provided to the pixels in each of the regions, and outputs the amount of current flown in each of the regions as the expected current based on the predetermined ratio. For example, the expected current Zx flown in the region increases at the predetermined ratio when the sum of the grayscale value Gx of the input data provided to the region increases.

Referring to FIG. 3B, the expected current calculator includes a look up table that stores the expected current corresponding to the grayscale value of the input data provided to each of the plurality of regions. The look up table can store the expected current to output brightness corresponding to the grayscale value of the input data provided to each of the plurality of regions. For example, the expected current calculator includes the look up table that stores the expected current Zx corresponding to the sum of the grayscale values Gx of the input data provided to each of the plurality of regions.

Figure 4A:
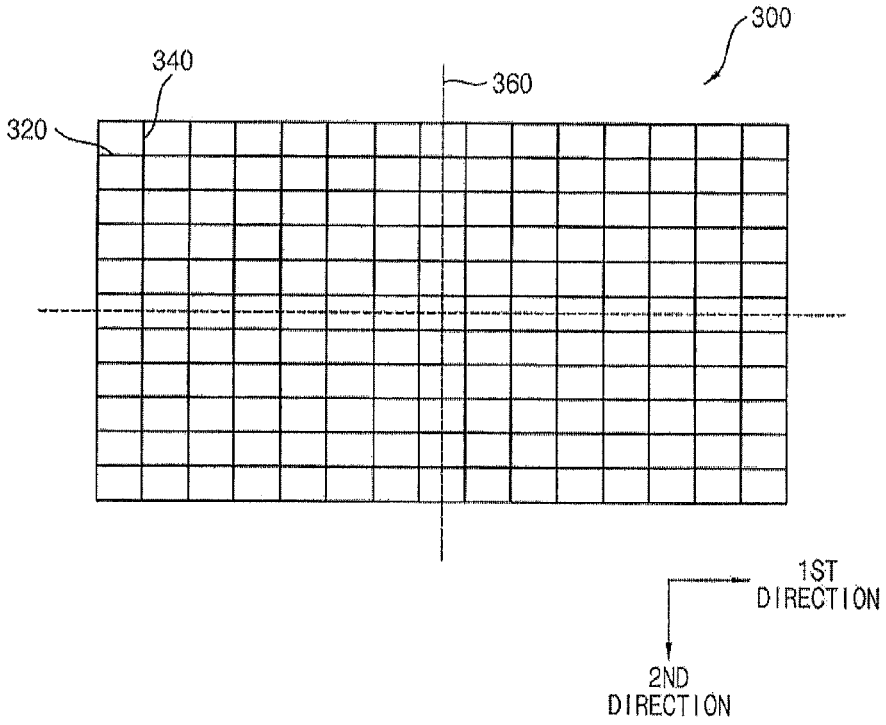
FIG. 4A is a diagram illustrating an example of power lines formed on the display panel coupled to the voltage drop compensator for FIG. 1.
Figure 4B:
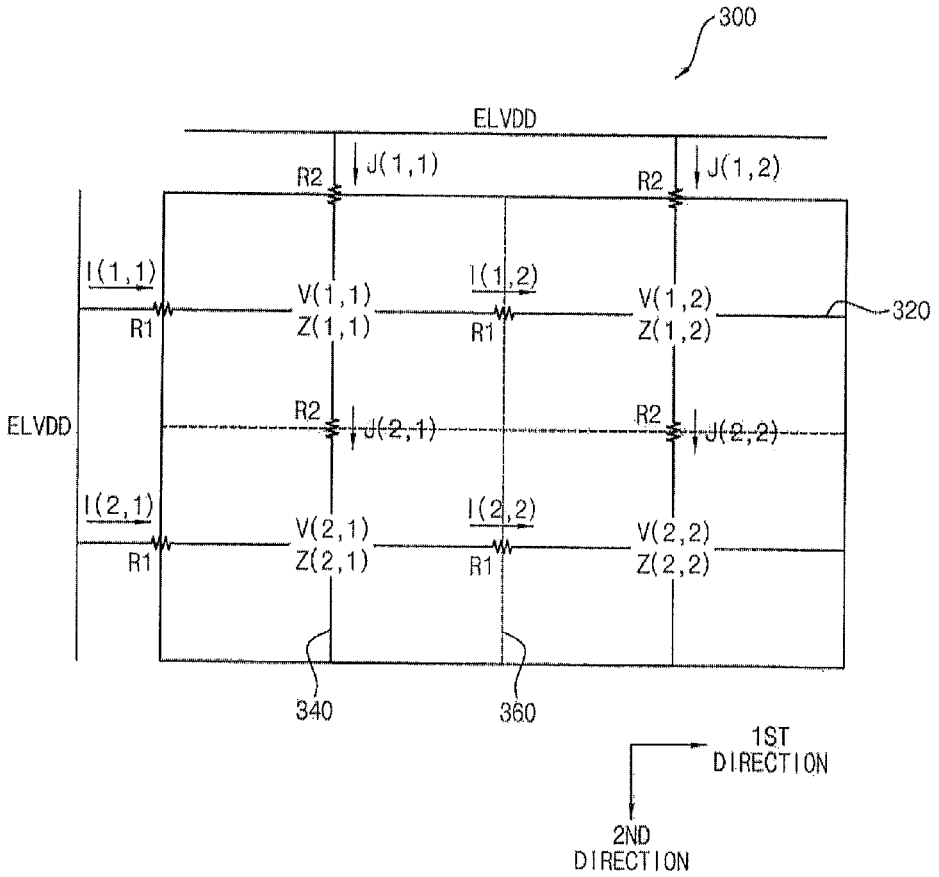
FIG. 4B is a diagram illustrating an example that the power voltage is provided to the display panel of FIG. 4A.

FIG. 4A is a diagram illustrating an example of power lines formed on the display panel coupled to the voltage drop compensator of FIG. 1. FIG. 4B is a diagram illustrating an example where the power voltage is provided to the display panel of FIG. 4A. FIG. 4C is a diagram for describing an operation of a conversion matrix generator included in the voltage drop compensator of the display panel of FIG. 1. FIG. 4D is a diagram for describing an operation of a representative voltage calculator included in the voltage drop compensator of the display panel of FIG. 1.

Referring to FIGS. 4A and 4B, power lines 320 and 340 are formed on the display panel 300 in a first direction and a second direction that is substantially perpendicular to the first direction. In some example embodiments, a material and a thickness of the power lines 320 formed in the first direction and the power lines 340 formed in the second direction are the same. In some example embodiments, the material and the thickness of the power lines 320 formed in the first direction and the power lines 340 formed in the second direction are different from each other. A region divider of the voltage drop compensator can divide the display panel 300 on which the power lines 320 and 340 are formed in the first direction and the second direction into a plurality of regions using a mutual line 360. A first power current I flowing through the power lines 320 formed in the first direction and a second power current J flowing through the power lines 340 formed in the second direction can be provided to each of the regions. Here, a voltage difference between the adjacent regions in the first direction and the second direction can exist due to line resistances R1 and R2 of the power lines 320 and 340 formed in the first direction and the second direction. The line resistance R1 of the power lines 320 formed in the first direction and the line resistance R2 of the power lines 340 formed in the second direction can be predetermined through a measurement or an experiment. In some example embodiments, the line resistance R1 of the power lines 320 formed in the first direction is the same as the line resistance R2 of the power lines 340 formed in the second direction. In some example embodiments, the line resistance R1 of the power lines 320 formed in the first direction is different from the line resistance R2 of the power lines 340 formed in the second direction. A first power current I(M,N) can be provided to the region in the Mth column and the Nth row in the first direction, where the M and N are natural numbers equal to or greater than 1. A second power current J(M,N) can be provided to the region in the Mth column and the Nth row in the second direction. A partial amount of the first power current I(M,N) can be flown in the region in the Mth column and the Nth row, and the rest of the first power current I(M, N+1) can be provided to the region in the Mth column and (N+1)th row in the first direction. Further, a partial amount of the second power current J(M,N) can flow in the region in the Mth column and the Nth row, and the rest of the second power current J(M+1,N) can be provided to the region in the (M+1)th column and the Nth row in the second direction. That is, the sum of the first power current I(M,N) and the second power current J(M,N) can be the same as the sum of the expected current Z(M,N) flown in the region in the Mth column and the Nth row, the first power current I(M,N+1) provided to the region in the Mth column and the (N+1)th row, and the second power current J(M+1,N) provided to the region in the (M+1)th column and the Nth row as described in the Equation 4.

$$I(M,N)+J(M,N)=Z(M,N)+I(M,N+1)+J(M+1,N) \quad \text{(EQ. 4)}$$

The difference between a representative voltage V(M,N) of the region in the Mth column and the Nth row and a representative voltage V(M, N+1) of the region in the Mth column and the (N+1)th row can be the same as the multiplication value of the line resistance R1 of the power lines formed between the region in the Mth column and the Nth row and the region in the Mth column and the (N+1)th row by the first power current I(M,N+1) provided to the region in the Mth column and (N+1)th row as described in the Equation 5.

$$V(M,N)-V(M,N+1)=R1\times I(M,N+1) \quad \text{(EQ. 5)}$$

The difference between a representative voltage V(M,N) of the region in the Mth column and the Nth row and a representative voltage V(M+1,N) of the region in the (M+1) th column and the Nth row can be the same as the multiplication value of the line resistance R2 of the power lines formed between the region in the Mth column and Nth row and the region in the (M+1)th column and Nth row by the second power current J(M+1,N) provided to the region in the (M+1)th column and Nth row as described in the Equation 6.

$$V(M,N)-V(M+1,N)=R2\times J(M+1,N) \quad \text{(EQ. 6)}$$

As described above, the Equation 1 can be derived by Equations 4-6. The conversion matrix generator can generate the resistance matrix based on the Equation 1. Referring to FIGS. 4C and 4D, the conversion matrix generator generates the resistance matrix A based on the Equation 1 when the display panel 300 on which the power lines 320 and 340 are formed in the first and second directions is divided into two columns and two rows. That is, the conversion matrix generator can generate the resistance matrix A that converts the representative voltage V to the expected current Z and can output an inverse of the resistance matrix A as the conversion matrix B. The conversion matrix generator can store the conversion matrix B in the look up table. The representative voltage calculator can calculate the representative voltages V by multiplying the conversion matrix B provided from the conversion matrix generator and the expected current Z provided from the expected current calculator.

Figure 5A:
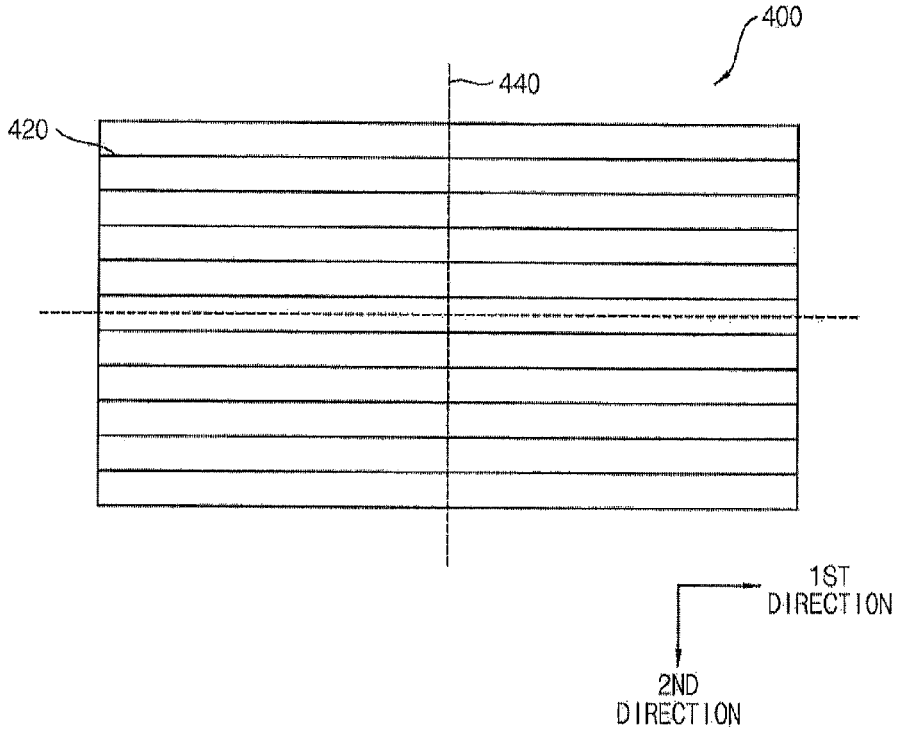
FIG. 5A is a diagram illustrating another example of power lines formed on the display panel coupled to the voltage drop compensator for FIG. 1.
Figure 5B:
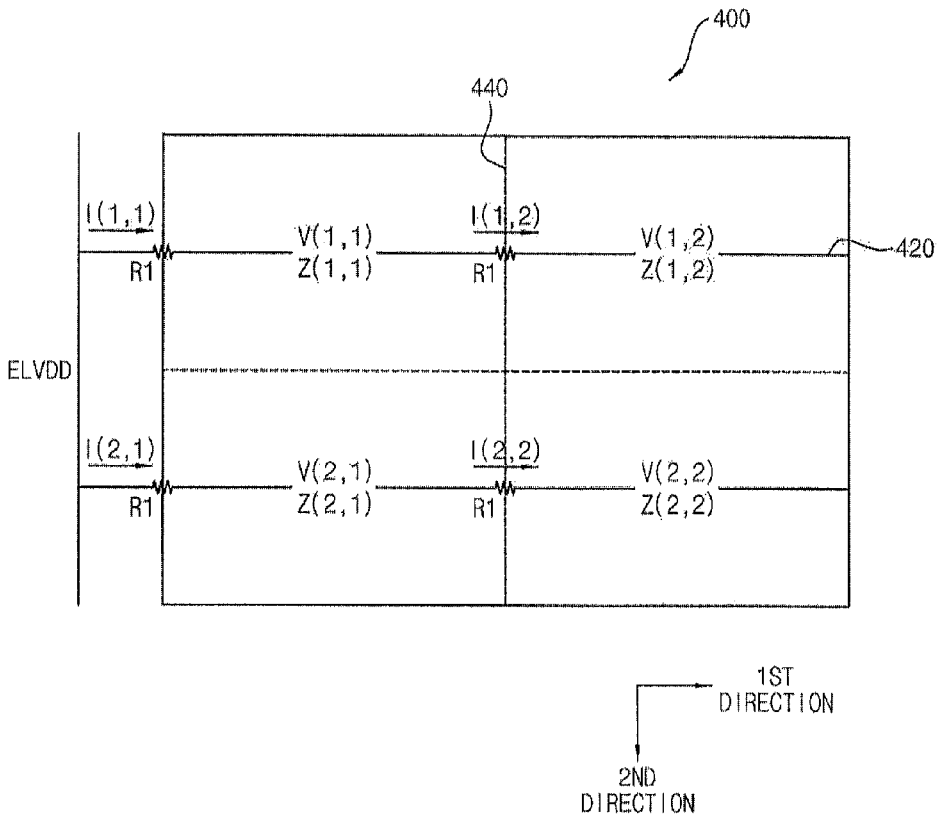
FIG. 5B is a diagram illustrating an example where the power voltage is provided to the display panel of FIG. 5A.

FIG. 5A is a diagram illustrating another example of power lines formed on the display panel coupled to the voltage drop compensator of FIG. 1. FIG. 5B is a diagram illustrating an example that the power voltage is provided to the display panel of FIG. 5A. FIG. 5C is a diagram for describing an operation of a conversion matrix generator included in the voltage drop compensator of the display panel of FIG. 1. FIG. 5D is a diagram for describing an operation of a representative voltage calculator included in the voltage drop compensator of the display panel of FIG. 1.

Referring to FIGS. 5A and 5B, power lines 420 are formed on the display panel 400 in a first direction. A region divider of the voltage drop compensator can divide the display panel 400 on which the power lines 420 are formed in the first direction into a plurality of regions using a mutual line 440. A first power current I flowing through the power lines 420 formed in the first direction can be provided to each of the regions. Here, a voltage difference between the adjacent regions in the first direction can exist due to line resistances R1 of the power lines 420 formed in the first direction. The first power current I(M,N) can be provided to the region in the Mth column and the Nth row in the first direction, where the M and N are natural numbers equal to or greater than 1. A partial amount of the first power current I(M,N) can be flown in the region in the Mth column and the Nth row and the rest amount of the first power current I(M,N+1) can be provided to the region in the Mth column and the (N+1)th row in the first direction. That is, the first power current I(M,N) can be the same as the sum of the expected current Z(M,N) flown in the region in the Mth column and the Nth row and the first power current I(M,N+1) provided to the region in the Mth column and the (N+1)th row as described in the Equation 7.

$$I(M,N)=Z(M,N)+I(M,N+1) \quad \text{(EQ. 7)}$$

The difference between a representative voltage V(M,N) of the region in the Mth column and the Nth row and a representative voltage V(M,N+1) of the region in the Mth column and the (N+1)th row can be the same as the multiplication value of the line resistance R1 of the power lines formed between the region in the Mth column and the Nth row and the region in the Mth column and the (N+1)th row by the first power current I(M,N+1) provided to the region in the Mth column and the (N+1)th row as described in the Equation 5. As described above, the Equation 2 can be derived by the Equation 5 and the Equation 7. The conversion matrix generator can generate the resistance matrix based on the Equation 2. Referring to FIGS. 5C and 5D, the conversion matrix generator can generate the resistance matrix C based on the Equation 2 when the display panel 400 on which the power lines 420 are formed in the first direction is divided into two columns and two rows. That is, the conversion matrix generator can generate the resistance matrix C that converts the representative voltage V to the expected current Z and can output an inverse of the resistance matrix C as the conversion matrix D. The conversion matrix generator can store the conversion matrix D in the look up table. The representative voltage calculator can calculate the representative voltages V by multiplying the conversion matrix D provided from the conversion matrix generator and the expected current Z provided from the expected current calculator.

Figure 6A:
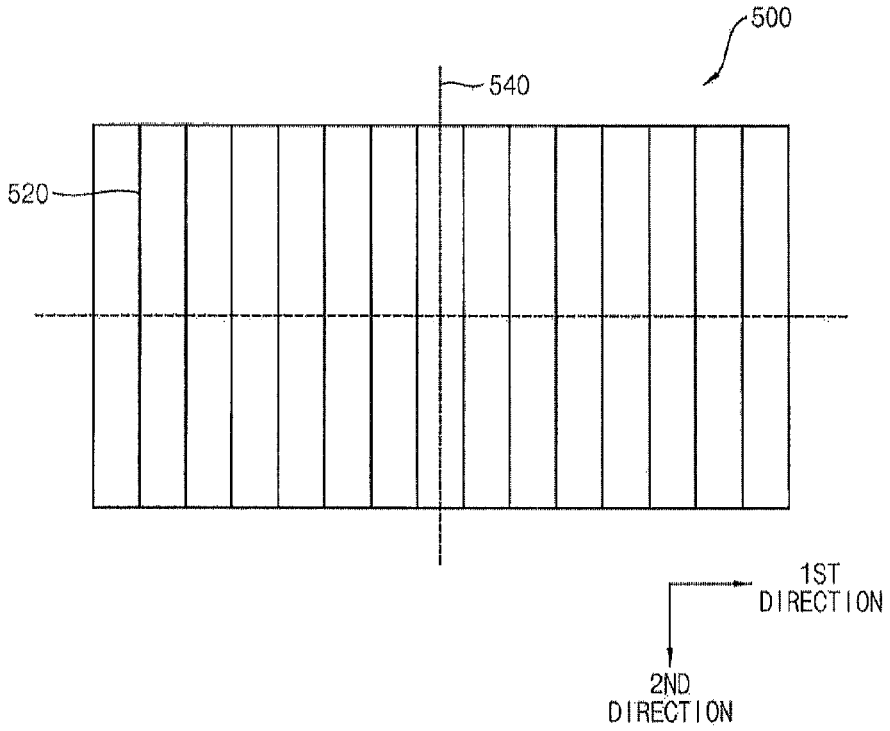
FIG. 6A is a diagram illustrating another example of power lines formed on the display panel coupled to the voltage drop compensator of FIG. 1.
Figure 6B:
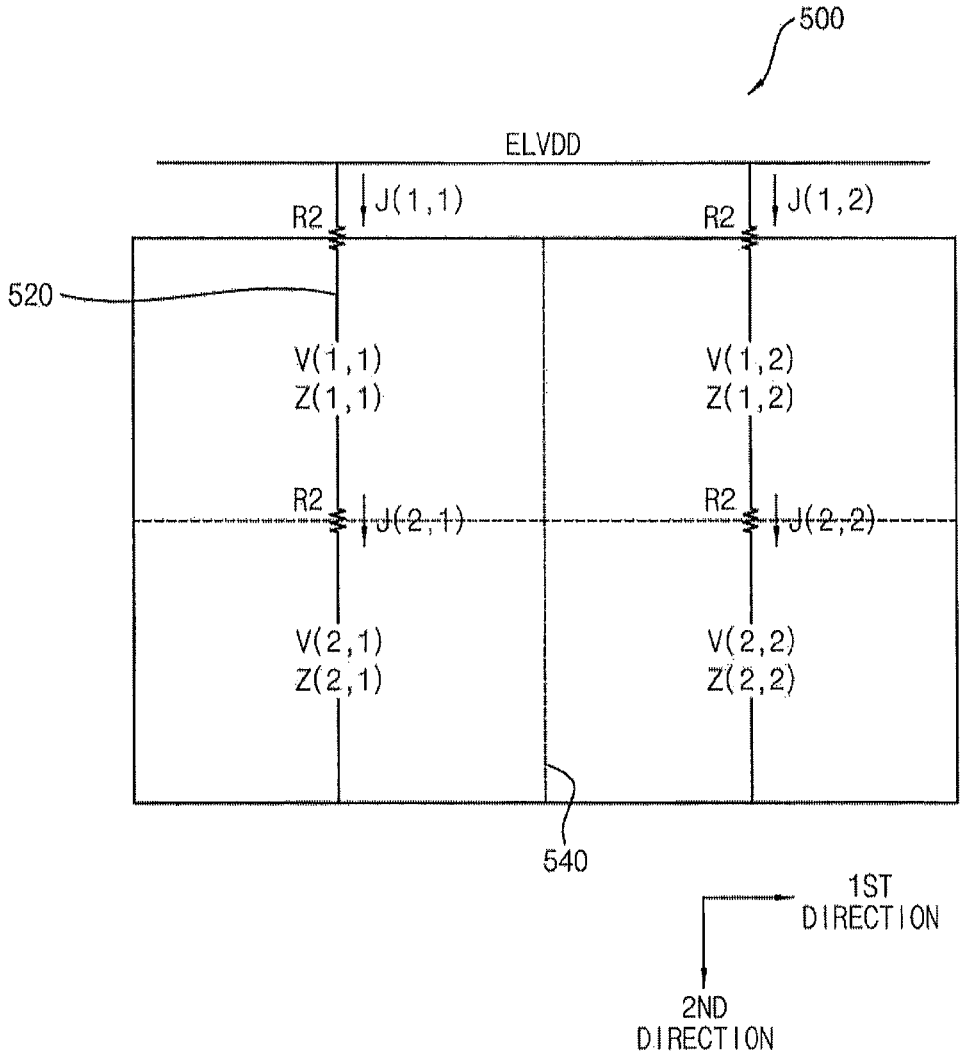
FIG. 6B is a diagram illustrating an example that the power voltage is provided to the display panel of FIG. 6A.

FIG. 6A is a diagram illustrating another example of power lines formed on the display panel coupled to the voltage drop compensator of FIG. 1. FIG. 6B is a diagram illustrating an example where the power voltage is provided to the display panel of FIG. 6A. FIG. 6C is a diagram for describing an operation of a conversion matrix generator included in the voltage drop compensator of the display panel of FIG. 1. FIG. 6D is a diagram for describing an operation of a representative voltage calculator included in the voltage drop compensator of the display panel of FIG. 1.

Referring to FIGS. 6A and 6B, power lines are formed on the display panel 500 in a second direction. A region divider of the voltage drop compensator can divide the display panel 500 on which the power lines 520 are formed in the second direction into a plurality of regions using a mutual line 540. A second power current J flowing through the power lines 520 formed in the second direction can be provided to each of the regions. Here, the voltage difference between the adjacent regions in the second direction can exist due to line resistances R2 of the power lines 520 formed in the second direction. The second power current J(M,N) can be provided to the region in the (M+1)th column and the Nth row in the second direction, where the M and N are natural numbers equal to or greater than 1. A partial amount of the second power current J(M,N) can flow in the region in the Mth column and the Nth row, and the rest of the second power current J(M+1,N) can be provided to the region in the (M+1)th column and the Nth row in the second direction. That is, the second power current J(M,N) can be the same as the sum of the expected current Z(M,N) and the second power current J(M+1,N) provided to the region in the (M+1)th column and the Nth row as described in the Equation 8.

$$J(M,N)=Z(M,N)+J(M+1,N) \quad \text{(EQ. 8)}$$

The difference between a representative voltage V(M,N) of the region in the Mth column and the Nth row and a representative voltage V(M+1,N) of the region in the (M+1)th column and the Nth row can be the same as the multiplication value of the line resistance R2 of the power lines formed between the region in the Mth column and the Nth row and the region in the (M+1)th column and the Nth row by the second power current J(M+1,N) provided to the region in the (M+1)th column and the Nth row as described in the Equation 6. As described above, the Equation 3 can be derived by the Equation 6 and the Equation 8. The conversion matrix generator can generate the resistance matrix based on the Equation 3. Referring to FIGS. 6C and 6D, the conversion matrix generator generates the resistance matrix E based on the Equation 3 when the display panel 500 on which the power lines 520 are formed in the second direction is divided into two columns and two rows. That is, the conversion matrix generator can generate the resistance matrix E that converts the representative voltage V to the expected current Z and can output an inverse of the resistance matrix C as the conversion matrix F. The conversion matrix generator can store the conversion matrix F in the look up table. The representative voltage calculator can calculate the representative voltages V by multiplying the conversion matrix F provided from the conversion matrix generator and the expected current Z provided from the expected current calculator.

Figure 7:
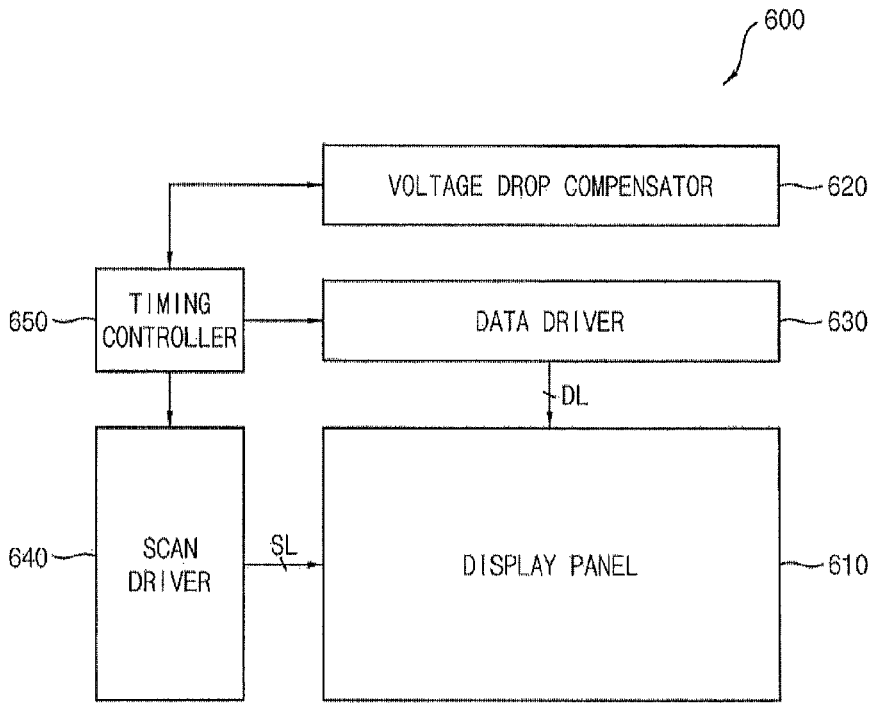
FIG. 7 is a block diagram a display device according to example embodiments.

FIG. 7 is a block diagram illustrating a display device according to example embodiments.

Referring to FIG. 7, the display device 600 includes a display panel 610, a voltage drop compensator 620, a data driver 630, a scan driver 640, and a timing controller 650.

The display panel 610 can include a plurality of pixels. In some example embodiments, each of the pixels includes a pixel circuit, a driving transistor, and an organic light emitting diode. In this case, the pixel circuit can control a current flowing through the OLED based on a data signal, where the data signal is provided via the data line DL in response to the scan signal, where the scan signal is provided via the scan line SL. In some example embodiments, power lines are formed on the display panel 610 in a first direction and a second direction that is substantially perpendicular to the first direction. In some example embodiments, the power lines are formed on the display panel 610 in the first direction. In some example embodiments, the power lines are formed on the display panel in the second direction.

The scan driver 640 can provide the scan signal to the pixels through the scan line SL. The data driver 630 can provide the data signal to the pixels through the data line DL in response to the scan signal. The timing controller 650 can generate a control signal that controls the data driver 630, the scan driver 640, and the voltage drop compensator 620.

The voltage drop compensator 620 can divide the display panel 610 into a plurality of regions, calculate a representative voltage of the regions by multiplying a conversion matrix determined based on a line resistance of the power line and an expected current spent in the plurality of regions, and compensate amounts of the voltage drop in the regions based on the representative voltage. For example, the voltage drop compensator 620 can include a region divider, an expected current calculator, a conversion matrix generator, a representative voltage calculator, and a compensator. The region divider can divide the display panel 610 that includes the power lines and the pixels to which the power voltage is provided through the power lines into a plurality of regions. The region divider can divide the display panel 610 into the regions using a mutual line. The expected current calculator can calculate the expected current spent in each of the regions based on input data provided to each of the regions. In some example embodiments, the expected current calculator calculates the expected current corresponding to grayscale values of the input data provided to each of the regions based on a predetermined ratio. The amount of the current spent for outputting brightness corresponding to the grayscale value, that is, the expected current can increase at predetermined ratio as the grayscale value provided to the pixel increases. For example, the expected current calculator calculates a sum of the grayscale values of the input data provided to the pixels in each of the regions, and output the amount of current spent in each of the regions as the expected current based on the predetermined ratio. In other example embodiments, the expected current calculator includes a look up table that stores the expected current corresponding to the grayscale value of the input data provided to each of the regions and output the expected current based on the look up table. For example, the expected current calculator includes the look up table that store the expected current corresponding to the sum of the grayscale value of the input data provided to each of the regions. The conversion matrix generator can generate the conversion matrix that converts the expected current to the representative voltage provided to the regions based on the line resistance occurs on the power line. In some example embodiments, the conversion matrix generator generates a resistor matrix based on Equation 1 that is derived using the power current flowing through the power lines and the line resistance of the power lines when the power lines are disposed on the display panel 610 in the first direction and the second direction that is perpendicular to (or crossing) the first direction. In other example embodiments, the conversion matrix generator generates the resistance matrix based on Equation 2 derived using the power current flowing through the power lines and the line resistance of the power lines when the power lines are disposed on the display panel 610 in the first direction. In other example embodiments, the conversion matrix generator generates the resistance matrix based on Equation 3 derived using the power current flowing through the power lines and the line resistance of the power lines when the power lines are disposed on the display panel 610 in the second direction. The conversion matrix generator can generate an inverse of the resistor matrix as the conversion matrix. The conversion matrix generator can include the look up table that stores the conversion matrix. The representative voltage calculator can calculate the representative voltage of the regions by multiplying the conversion matrix and the expected current. The representative voltage calculator can receive the conversion matrix from the conversion matrix generator and expected current spent in each of the regions from the expected current calculator. The representative voltage of each of the regions can be calculated by multiplying the conversion matrix and the expected current. The compensator can calculate an amount of the voltage drop of each of the regions based on the representative voltage and output a compensated data that compensates the amount of the voltage drop of each of the regions. The compensator can calculate the amount of the voltage drop by comparing the representative voltage to a predetermined reference voltage. The voltage drop compensator 620 can further include an interpolator that interpolates the representative voltages of the regions. The interpolator can calculate the voltage of pixels by interpolating the representative voltages calculated in the representative voltage calculator. Thus, the amount of the voltage drop occurred on the display panel 610 can be minutely compensated.

As described above, the display device 600 of FIG. 7 can include the voltage drop compensator 620 that compensates the voltage drop of the display panel 610 on which the power lines are formed. The voltage drop compensator 620 can divide the display panel 610 into the regions, calculate the expected current flown in each of the regions based on the input data, and can calculate the conversion matrix based on the line resistance of the power lines and the expected current. The voltage drop compensator can calculate the representative voltage in each of the regions based on the conversion matrix and the expected current, and compensate the amount of the voltage drop in each of the regions based on the representative voltage. Thus, the display device 600 that includes the voltage drop compensator 620 can improve a display quality.

The described technology can be applied to a display device and an electronic device including the display device. For example, the described technology can be applied to computer monitors, laptop computers, digital cameras, cellular phones, smartphone, smart pads, televisions, personal digital assistants (PDAs), portable multimedia players (PMP), MP3 players, navigation systems, game consoles, video phones, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A voltage drop compensator for a display panel, comprising:

a region divider configured to divide the display panel into a plurality of regions, wherein the display panel includes a plurality of power lines and a plurality of pixels configured to receive a power voltage via the power lines;

an expected current calculator configured to calculate an expected current to flow in each of the regions based on input data provided to each of the regions;

a conversion matrix generator configured to generate a conversion matrix based on a line resistance of each of the power lines and convert the expected current to a representative voltage provided to the regions based on the conversion matrix;

a representative voltage calculator configured to multiply the conversion matrix and the expected current so as to calculate the representative voltage; and a compensator configured to calculate an amount of a voltage drop in each of the regions based on the representative voltage and output a compensated data so as to compensate for the amount of the voltage drop in each of the regions, wherein the conversion matrix generator is further configured to generate the conversion matrix based on a power current flowing through each of the power lines.

2. The voltage drop compensator of claim 1, wherein the power lines are formed over the display panel in a first direction and a second direction crossing the first direction.

3. The voltage drop compensator of claim 2, wherein the conversion matrix generator is further configured to generate a resistance matrix based on the equation, "$Z(m,n)=\{V(m,n-1)-2V(m,n)+V(m,n+1)\}/R1+\{V(m-1,n)-2V(m,n)+V(m+1,n)\}/R2$", where the m, n are natural numbers equal to or greater than 1, Z is the expected current, V is the representative voltage, R1 is the line resistance of the power lines formed in the first direction, and R2 is the line resistance of the power lines formed in the second direction, and wherein the conversion matrix generator is further configured to generate an inverse of the resistance matrix as the conversion matrix.

4. The voltage drop compensator of claim 1, wherein the power lines are formed in a first direction.

5. The voltage drop compensator of claim 4, wherein the conversion matrix generator is further configured to generate a resistance matrix based on the equation, "$Z(m,n)=\{V(m,n-1)-2V(m,n)+V(m,n+1)\}/R1$", where the m, n are natural numbers equal to or greater than 1, Z is the expected current, V is the representative voltage, and R1 is the line resistance of the power lines formed in the first direction, and wherein the conversion matrix generator is further configured to generate an inverse of the resistance matrix as the conversion matrix.

6. The voltage drop compensator of claim 1, wherein the power lines are formed in a second direction crossing a first direction.

7. The voltage drop compensator of claim 6, wherein the conversion matrix generator is further configured to generate a resistance matrix based on the equation, "$Z(m,n)=\{V(m-1,n)-2V(m,n)+V(m+1,n)\}/R2$", where the m, n are natural numbers equal to or greater than 1, Z is the expected current, V is the representative voltage, and R2 is the line resistance of the power lines formed in the second direction, and wherein the conversion matrix generator is further configured to generate an inverse of the resistance matrix as the conversion matrix.

8. The voltage drop compensator of claim 1, wherein the conversion matrix generator includes a look up table (LUT) configured to store the conversion matrix.

9. The voltage drop compensator of claim 1, wherein the expected current calculator is further configured to calculate the expected current corresponding to grayscale values of the input data based on a predetermined ratio.

10. The voltage drop compensator of claim 1, wherein the expected current calculator includes a look up table (LUT) configured to store the expected current corresponding to grayscale values of the input data.

11. The voltage drop compensator of claim 1, further comprising an interpolator configured to interpolate the representative voltages of the regions.

12. The voltage drop compensator of claim 1, wherein the expected current calculator does not receive any input from the display panel.

13. A display device, comprising:

a display panel including a plurality of power lines and a plurality of pixels configured to receive a power voltage via the power lines;

a voltage drop compensator configured to divide the display panel into a plurality of regions, calculate a conversion matrix and an expected current to flow in the regions so as to calculate a representative voltage of the regions, and compensate for an amount of a voltage drop of the regions based on the representative voltage;

a data driver configured to provide a data signal to the pixels;

a scan driver configured to provide a scan signal to the pixels; and a timing controller configured to control the data driver, the scan driver, and the voltage drop compensator, wherein the voltage drop compensator is further configured to generate the conversion matrix based on a power current flowing through each of the power lines.

14. The display device of claim 13, wherein the voltage drop compensator includes:

a region divider configured to divide the display panel into the regions;

an expected current calculator configured to calculate the expected current to flow in each of the regions based on input data provided to each of the regions;

a conversion matrix generator configured to generate the conversion matrix and convert the expected current to the representative voltage provided to the regions based on the line resistance of each of the power lines;

a representative voltage calculator configured to multiply the conversion matrix and the expected current so as to calculate the representative voltage; and a compensator configured to calculate the amount of the voltage drop in each of the regions based on the representative voltage and output compensated data so as to compensate for the amount of the voltage drop in each of the regions.

15. The display device of claim 14, wherein the conversion matrix generator is further configured to generate a resistance matrix based on the equation, "$Z(m,n)=\{V(m,n-1)-2V(m,n)+V(m,n+1)\}/R1$", where the m, n are natural numbers equal to or greater than 1, Z is the expected current, V is the representative voltage, and R1 is the line resistance of the power lines formed in a first direction, wherein the conversion matrix generator is further configured to generate an inverse of the resistance matrix as the conversion matrix, and wherein the power lines are formed in the first direction on the display panel.

16. The display device of claim 14, wherein the conversion matrix generator is further configured to generate a resistance matrix based on the equation, "$Z(m,n)=\{V(m,n-1)-2V(m,n)+V(m,n+1)\}/R1+\{V(m-1,n)-2V(m,n)+V(m+1,n)\}/R2$", where the m, n are natural numbers equal to or greater than 1, Z is the expected current, V is the representative voltage, R1 is the line resistance of the power lines formed in a first direction, and R2 is the line resistance of the power lines formed in a second direction, wherein the conversion matrix generator is further configured to generate an inverse of the resistance matrix as the conversion matrix, and wherein the power lines are formed in the first direction and the second direction crossing the first direction on the display panel.

17. The display device of claim 14, wherein the conversion matrix generator is further configured to generate a resistance matrix based on the equation, "Z(m,n)={V(m-1, n)-2V(m, n)+V(m+1,n)}/R2", where the m, n are natural numbers equal to or greater than 1, Z is the expected current, V is the representative voltage, and R2 is the line resistance of the power lines formed in the second direction, wherein the conversion matrix generator is further configured to generate an inverse of the resistance matrix as the conversion matrix, and wherein the power lines are formed in the second direction on the display panel.

18. The display device of claim 14, wherein the expected current calculator is further configured to calculate the expected current corresponding to grayscale values of the input data based on a predetermined ratio.

19. The display device of claim 14, further comprising an interpolator configured to interpolate the representative voltages of the regions.

* * * * *